United States Patent [19]

Florko, Jr.

[11] 4,070,931

[45] Jan. 31, 1978

[54] LUG WRENCH

[76] Inventor: Nicholas Florko, Jr., 161 Marine Drive Apartment 6D, Buffalo, N.Y. 14202

[21] Appl. No.: 720,815

[22] Filed: Sept. 7, 1976

[51] Int. Cl.[2] ..... B25B 13/00

[52] U.S. Cl. ..... 81/177 B

[58] Field of Search ..... 7/1 E; 81/52.3, 177 A, 81/177 B

[56] References Cited

U.S. PATENT DOCUMENTS

| | | | |
|---|---|---|---|
| 2,627,330 | 2/1953 | Gantz | 81/177 B X |
| 3,158,050 | 11/1964 | Shandel | 81/177 B X |
| 3,649,976 | 3/1972 | Isom | 81/177 B X |

FOREIGN PATENT DOCUMENTS

| | | | |
|---|---|---|---|
| 606,129 | 3/1926 | France | 81/177 B |
| 326,941 | 6/1935 | Italy | 81/177 B |

*Primary Examiner*—James L. Jones, Jr.
*Assistant Examiner*—James G. Smith
*Attorney, Agent, or Firm*—Raymond F. Kramer

[57] ABSTRACT

A lug wrench for removing automobile wheel lug nuts from wheel lugs includes a socket or means for holding a socket which fits such nuts, turning means, fastened to or integral with said socket or socket holding means and connectable lever means, the turning means including a cylindrical rod portion extending in a direction opposite to that of the wheel lug and offset from it and acting as a fulcrum, and a bearing portion, against which the lever can bear to turn the socket, and the lever having a collar at an end thereof and a handle portion at an opposite end, the collar being adapted to fit about the fulcrum rod of the turning means and the lever being adapted to bear against the bearing portion of the turning means to turn the socket with balanced forces thereon when a force is applied to the handle of the lever.

10 Claims, 6 Drawing Figures

LUG WRENCH

This invention relates to an improved lug wrench. More particularly, it relates to a two-piece or three-piece combination lug wrench of such construction as to facilitate even application of turning forces to an automobile wheel lug nut and to allow easy application of turning forces, especially impact and foot transmitted forces, to such nut, when desired. The invented lug wrench is especially adapted for step-on use, either to apply a steady force or an impact force and after "cracking" or loosening of the lug nut the lever portion of the wrench may be withdrawn and the remaining portion easily "spun" without any part thereof being interfered with by undesirable contact with the wheel, tire or the ground, such as is sometimes made by lug wrench handles.

Lug wrenches, in their simplest form, include a socket at an end thereof and a handle extending from the socket at an oblique angle with respect to the socket axis, usually about 100° to 135°, e.g., 105°. The handle will be long enough to allow the application of a sufficient levered force to the socket to loosen the wheel nut (lug nut) and the oblique angle will be sufficient so that the end of the handle does not contact the wheel or tire and desirably, does not contact the ground, at least not when upper and middle height wheel nuts are being removed. Such lug wrenches, because of the unbalanced application of turning forces to the socket and the nut, tend to slip off the lug nut and often the nut cannot be spun off, once loosened, because of the handle contacting the ground or other obstruction, at least when lower wheel nuts are being removed. Furthermore, when emergency tire (and wheel) changes are made on the road it may be necessary for a woman or a person of comparatively little strength to loosen the wheel nuts and sometimes this cannot be done by hand, necessitating the application of extra force and/or body weight to the lug wrench by stepping on it or stamping on the handle end thereof. Because of the poorly balanced forces applied to the socket the wrench can become disengaged from the lug nut and injury can result. To overcome the various disadvantages of the conventional lug wrench, T-shaped wrenches have been manufactured, in which handle portions extend equal distances from and transversely to the axis of a rod bearing the socket. See U.S. Pat. Nos. 1,282,028 and 1,630,848 for some examples of these. A modification of these wrenches is the X-wrench or cross-wrench wherein four differently sized sockets are present, one at each end of the X or cross. The T and X wrenches allow even applications of steady turning forces to a lug nut but do not provide means for evenly applying impact forces or for applying a turning force or impact by foot. Also, if the handles are long enough to give good leverage they may be long enough to objectionably contact the ground or other obstruction, necessitating periodic removal of the socket from the lug nut while turning it to remove it.

Complex devices for removing wheel nuts and bolts from tires, such as truck tires, have been patented, the objects of which are to maintain the socket tightly against the lug nut or lug and to facilitate rotation of the socket. Some such devices are illustrated in U.S. Pat. Nos. 2,549,910; 2,761,340; 3,069,945; and 3,097,550. However, it is apparent that such tools or machines are too complicated and expensive for ordinary use by the average motorist. Improved lug wrench tool designs are illustrated in U.S. Pat. Nos. 3,872,527 and 3,928,877, in both of which means are provided on the lug wrench for applying a force to the tool to maintain the socket thereof tightly in contact with the lug nut. A square Y-shaped combination tool including a lug wrench is shown in U.S. Pat. No. 3,649,976. However, neither this structure nor those of the other two recent patents mentioned allows the ready performance of the loosening and tightening operations possible with the tool of the present invention.

In accordance with the present invention a lug wrench comprises: (A) a socket for gripping a lug nut or lug head or means for holding such a socket; (B) turning means fastenable or fastened to said socket or fastened to said holding means and having two parts, first and second parts, extending at least partially opposite to the direction of the lug; and (C) lever means connectable to the first part of the turning means and rotatable with respect to it and bearable against the second part thereof, against which it can apply a force, so as to make a lever with a fulcrum where it is connectable with the first part and a point of application of force where it bears against the second part, so that on applying force to an end of such lever away from the fulcrum the socket or a socket on the holding means, when gripping a lug nut or lug head, applies a turning force to such nut or head. In preferred embodiments of the invention the tool is of two or three pieces, depending on whether the socket is built into the tool or removable from it and depending on whether the tool is supplied with a socket or with means for fastening to a separately obtained socket. In such preferred embodiments the lever part has a collar at one end and a handle or foot actuatable projection at the other end and is adapted to turn about a fulcrum portion of a separate turning member (to which a socket is affixed or affixable) and bear against another portion of said turning member so as to apply a balanced turning force to the socket. The sizes of the parts wil be chosen so as to provide desirable leverage by means of the lever and, when it is disengaged and removed, to allow ready spin rotation of the lug nut by turning the turning member, with the socket thereon engaging the lug nut. In specific embodiments of the invention the turning member of the lever may have a pointed or pry section at an end thereof to facilitate wheel disc removal or may be adapted for use as a jack handle, wrench, screwdriver or hammer.

The invention will be readily understood by reference to the following description, taken in conjunction with the rest of this specification and the drawing, in which.

Figure 1:
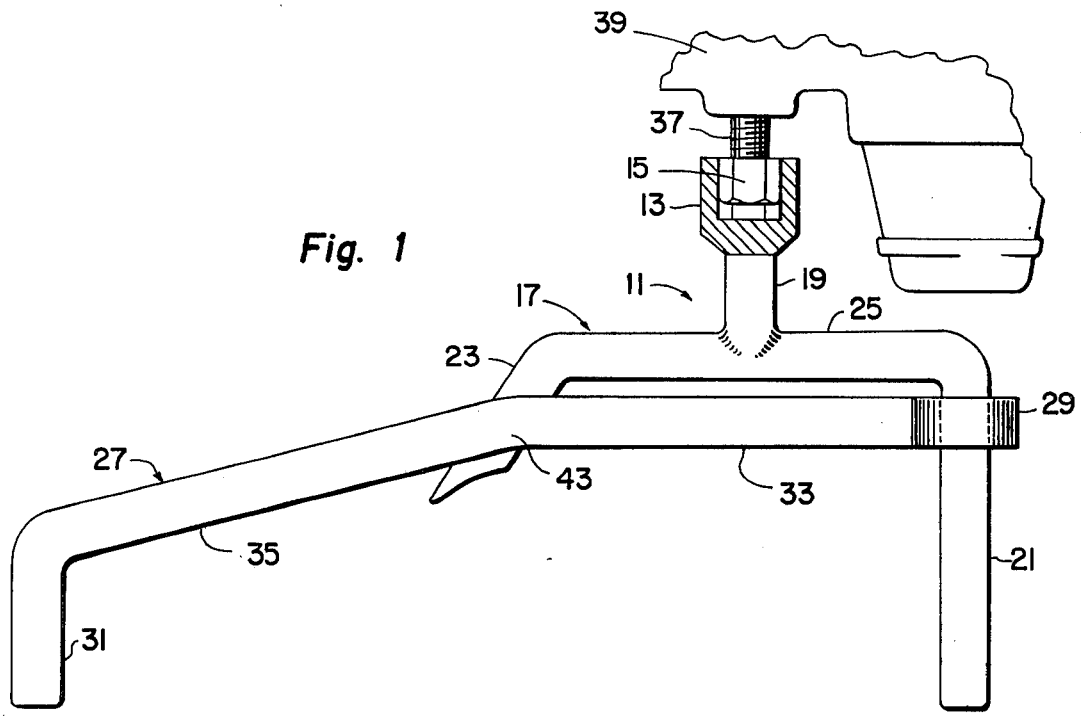
FIG. 1 is a top plan view, sectioned in part, of a tool of this invention in operating (loosening) position with respect to an automobile wheel lug nut.

In FIG. 1 combination lug wrench 11 includes socket 13 for gripping lug nut 15 or a head of a lug or other wheel nut. It also includes turning means 17 fastened to socket 13 by connecting rod 19, which, as shown, is welded to socket 13 and turning means 17. Instead of utilizing the connecting cylindrical rod 19 between socket 13 and turning means 17 the socket itself may be directly fastened to the turning means or, as shown in FIG'S. 3 and 4, means for holding a socket may be fastened to or incorporated in the turning means and a removable socket may be associated with such holding means. Turning means 17 includes a first and second parts 21 and 23, respectively, connected by a third part 25 and the turning means may be considered as being of a J- or modified U-shape. Both first and second parts 21 and 23 extend at least partially in a direction opposite to that of the lug. By that is meant that they extend in a direction which has a component parallel to the axis of the lug, with the sides of the U or J extending or opening in a direction opposite to the lug, with respect to the base or third part of the turning means. Lever means 27 is connectable to the first part of the turning means 17 by collar 29 which fits about said first part. Collar 29 is at an end of lever 27 and is connected to handle or foot contact part 31 at the other end thereof by substantially transversely extending portion 33 and angled portion 35.

Figure 2:
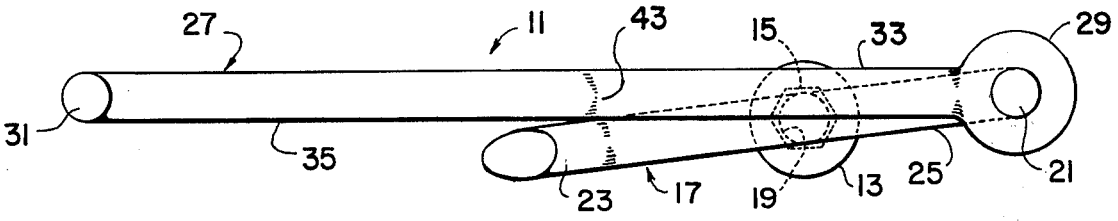
FIG. 2 is a side elevation of such tool, viewed from the operational end thereof.

As is illustrated in FIGS. 1 and 2, when a socket 13 of combination tool 11 is in position on lug nut 15, held on lug 37 and holding wheel 39 to its associated axle (not shown), the lug nut may be loosened by applying a force downwardly on handle 31, thereby turning the lug nut counterclockwise with respect to the lug, viewing the lug from the nut end thereof. The first part 21 of turning means 17 acts as a fulcrum about which collar 29 is rotatable and the second part 23 of said turning means has a bearing section 43 of lever 27 bearing against it and exerting a turning force on it when such a force is applied to handle 31. It is seen that because the fulcrum and the point of application of force to the turning member are about equidistant from the axis of connecting rod 19, socekt 13 and lug nut 15, approximately equal turning forces are applied to both the first and second parts of the turning member, thereby preventing imbalance disengagement of the socket from the lug nut. Usually the distances between the fulcrum and the socket axis and the bearing location and the socket axis will be exactly the same but variations plus or minus 25% are often tolerable (although not desirable). Also contributory to the easy holding of the lug wrench in place on the lug nut is the orientation of third or connecting part 25 of turning means 17, which is substantially and preferably exactly transverse to the axis of the socket. However, alignments of deviations of $\pm 10°$ and in some cases even as great as $\pm 30°$ are useful providing that the fulcrum—axis and bearing point—axis distances are as previously given or approximately so.

Second part 23 of turning means 17, as illustrated, is not directly parallel to the axis of the socket but is shown as inclined to said axis so as to provide a desirable angle for use of the end thereof as a sharpened pry and/or screwdriver, the pry (or screwdriver) being useful for assisting in removing wheel covers or discs, such as those conventionally used, from their normal press fits against automobile wheels. Instead of 30°, the angle may sometimes be desirably set to between 0° and 45° or the end may be curved or of other suitable shape.

Lever means 27, as illustrated, has a part of the connecting section between the collar and handle portions thereof inclined so that when the handle is rotated it will not strike the wheel, tire or ground. Of course, the other dimensions of the tool, especially the lengths of rod 19 and part 25, will be chosen to avoid such interferences. As illustrated, the means for connecting lever 27 with turning means 17 is collar 29 but other means for removably and rotatably fastening the lever to the turning means may be used instead. For example, a split collar or bearing may be utilized, adapted to hold the turning means having first parts of different thicknesses. Also, the fulcrum and bearing portions in the drawing illustrated may be reversed, usually providing that part 23 is aligned parallel to socket 13, but such modification is not preferred.

The advantages of the present invention are evident from the illustrated structure and the previous disclosure. Thus, the lever may be used to apply steady even balanced forces to turn the lug nut or lug, either to loosen it or to tighten it. In the case where the nut is so tightly held in position that it cannot be loosened by the application of a steady force of reasonable magnitude a hammering action can be created and a series of impacts can be transmitted to the lug nut by moving the lever into repeated sharp contacts with the turning member by raising and lowering it by hand. Either steady force or impact force may be applied by stepping down on handle 31 or repeatedly applying one's shod foot to such handle. Once the lug nut is loosened lever 27 may be removed and the nut may be more quickly screwed of by turning smaller turning member 17, as by spinning such member. In a similar manner, the lug nuts may be more easily tightened after replacement of an automobile wheel. If desired, the lever 27 may be held to turning member 17 so that it cannot be removed therefrom, preventing loss of such part, but normally ready removability is highly desirable. Of course, the lever and turning parts may be adpated for other combination tool uses than as the pry and screwdriver illustrated. For example, either or both may be sized so as to act as a handle for a jack, a hammer, a pry, a screwdriver, a wrench (socket or Allen type) or to perform some other desirable function relevant to automotive operation or repair.

Figure 3:
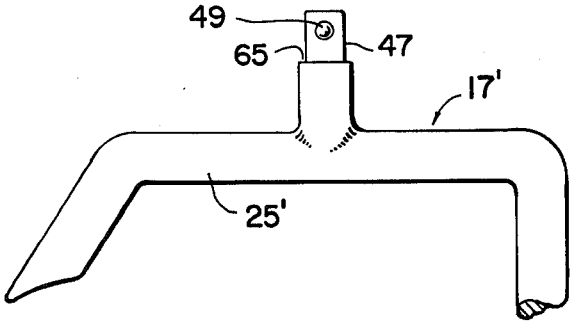
FIG. 3 is a partial view of a portion of a different embodiment of a part of the invented tool, corresponding to that of FIG. 1, shown in top plan view.
Figure 4:
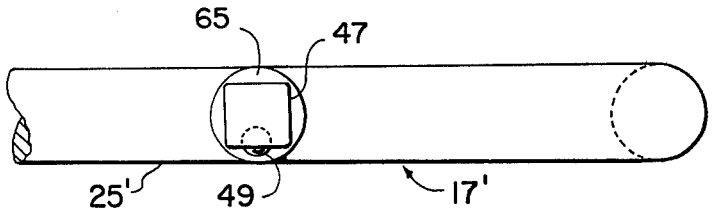
FIG. 4 is a side elevational view of the portion of the tool of FIG. 3, corresponding to the view of FIG. 1.

In FIGS. 3 and 4 portions of turning means 17' are shown with means for holding a separable socket in place instead of being shown with the socket incorporated into the tool. The rest of the tool, not shown, the balance of the turning means and the lever, may be considered as being the same as those of FIGS. 1 and 2. Turning means 17' includes a third transverse portion 25' and projection 47, of square cross section, mounted thereon. Projection 47 has a spring loaded ball 49 therein, the function of which is to engage an interior groove or indentation in a socket and removably hold it in place on the present tool. Thus, the tool is adapted to be utilized with sockets of different sizes and additionally, can be employed with extensions fitting onto projection 47 and connecting to any of various suitable sockets, such extensions, in effect, taking the place of connecting rod 19, shown in FIGS. 1 and 2.

Figure 5:
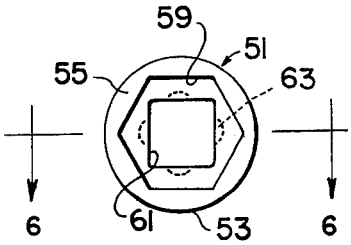
FIG. 5 is a side elevational view of a socket adapted to be fitted on the portion of the tool shown in FIG'S 3 and 4 viewed from the open end thereof.
Figure 6:
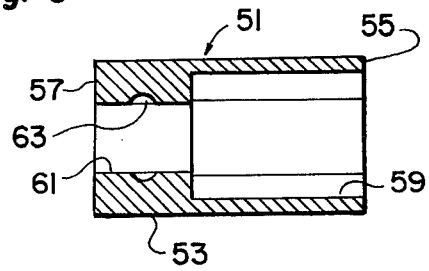
FIG. 6 is a central sectional plan of the socket of FIG. 5, taken along plane 6—6 of FIG. 5.

The socket employed with the tool part shown in FIGS. 3 and 4 is of conventional structure and is illustrated in FIGS. 5 and 6. Such a socket 51 includes a body 53 having a nut end 55 and tool or driver end 57. The nut end is internally shaped to fit a lug nut. As shown, such end has a hexagonal internal wall 59 extending far enough into the socket to hold a sufficient portion of the nut to allow turning of it in response to the wrench force, without marring it. At the other end of the socket a square walled drive opening is defined by walls 61, adapted to closely fit projection 47 on the combination tool of this invention, part of which is illustrated in FIGS. 3 and 4. Of course, the hexagonal and square cross-sections can be changed to other polygonal shapes. Normally, the clearance between the socket tool end interior wall and the projection will be small, usually being from 0.1 to 1 millileter. Similarly small clearances are desirable between the socket end interior wall and the lug nut onto which it fits. Depression 63 in the tool end interior wall of the socket is so located as to mate with spring loaded spherical ball 49 of the present tool, holding the socket in position on the tool, when desired. Shoulder 65 (see FIGS. 3 and 4) is preferably also adapted to bear against end 57 of socket 51, while detent ball 49 is in position in depression 63.

The materials of construction utilized in making the present tool may be those commonly employed for the manufacture of lug wrenches. Thus, hot- or cold-rolled steel bar stock or other suitable material of similar or greater strength will normally be employed for the turning and lever members and a tempered or otherwise hardened or alloy steel will be used for the socket. Alloys may be employed and the various parts may be chrome or nickel plated or painted. The simplest way to manufacture the tool is to cut and bend cylindrical bar stock to shape and then weld on the collar and socket or holder parts. However, it is contemplated that casting or drop forging may also be utilized for making some of all of the parts. Also, the spring loaded detent feature may be modified or may be omitted from the tool, if desired.

The various angles may be modified, in accord with this invention, to make the tool most useful for particular vehicles and applications and dimensions may be changed accordingly. While it is usually preferred to employ one-half inch to three-quarter inch diameter cylindrical solid bar stock, such as ⅝ inch stock, other diameters may be used too, from ⅜ inch to 1 inch, and hollow tubular stock may also be utilized.

In a preferred embodiment of the invention the socket extends about 3 inches from the transverse or third part of the turning means, the turning means is about 7 inches across and the first part thereof, extending parallel to and away from the socket, is about 5½ inches long, with the second part being inclined 30° from the axis of the socket and extending about 2½ inches. The lever is about 13 inches long, with the collar closely fitting the first part of the turning means, being of an internal diameter of about 0.64 inch, with a clearance of about 0.005 to 0.01 inch. The transverse section of the lever adjacent the collar is about 5½ inches long and the next adjacent angular section, angled 104° from the lug axis, is about six inches long, with the handle or foot actuated end section being about 3½ inches long. Although such dimensions are considered to be highly preferable for the present tool when employed for average automotive repair uses, they may be changed for particular applications without losing the significant advantages of the present tool. Similarly, materials of construction, methods of manufacture and the external appearance of the tool may be modified and ornamentation and other tool elements may be added.

The present invention has been described with respect to various illustrative embodiments and examples thereof but it is evident that one of skill in the art, with the present specification before him, will be able to utilize substitutes and equivalents without departing from the invention. Thus, in the broad embodiments of the invention, the lug wrench may have the socket portion thereof replaced with another driving means, such as an Allen type wrench, adjustable wrench, etc. Also, in accordance with the broader aspects of the invention, the lug wrench or other wrench includes a socket or other suitable means for engaging a nut or screw head, turning means fastenable or fastened to said engaging means, and lever means connectable to said turning means and rotatable with respect to it so as to be bearable against parts of the turning means in such a way as to exert balanced forces against the turning means to turn it and a lug nut or lug to which it is connected, by application thereto of balanced forces. For example, within such broader description of the invention is a tool in which the turning means includes a fulcrum rod extending coaxial with the means for engaging the nut or screw head and the lever is pivoted on such rod, exerting balanced forces on the turning rod ends, which are essentially the same as those illustrated in the drawing. Such structures and others within the invention may also include the impact structures previously described and equivalents thereof.

What is claimed is:

1. A lug wrench which comprises a socket for gripping a lug nut or lug head, turning means held to said socket for turning it, said turning means having two parts, first and second parts, extending at least partially opposite to the direction of the lug when the lug wrench is in operative position, and offset with respect to it, the first part extending parallel with and opposed to the direction of the lug, and lever means connectable to the first part of the turning means in pivotal relationship, rotatable with respect to said first part of the turning means and bearable against the second part thereof, against which it applies a force so as to make a lever with a fulcrum where it is pivotally connected with the first part of the turning means and a point of application of force where it bears against the second part thereof, so that on applying a turning force to an end of such lever away from the fulcrum, the socket, when gripping a lug nut or lug head, applies a balanced turning force to said lug nut or lug head, thus facilitating ready release of a lug nut or a lug without the socket slipping off said lug nut or lug because of application of unbalanced forces thereto.

2. A lug wrench according to claim 1 wherein the first and second parts of the turning means are so located that the distance from the fulcrum to the axis of the socket is about the same as the distance from such axis to the point at which the connectable lever means bears against the second part of the turning means, so that balanced rotational forces are applied to the socket when a turning force is applied to the connectable lever means.

3. A lug wrench according to claim 2 wherein the lever means pivotally connectable with the first part of the turning means includes a collar at an end thereof away from the end at which a force is applied to the lever, which collar and the lever are rotatable about said first part of the turning means, includes a handle or foot contact part away from the collar and extending substantially parallel to the lug direction and away from it and includes a portion extending substantially transversely to the lug direction when said lever means is positioned for use, which portion connects the collar and handle or foot contact part.

4. A lug wrench according to claim 3 wherein the first part of the turning means is of cylindrical shape and the collar part of the connectable lever fits about it closely and rotatably.

5. A lug wrench according to claim 4 wherein the second part of the turning means terminates in a pointed portion for assisting in removing an automobile wheel disc or cover from its position on said wheel.

6. A lug wrench which comprises means for holding a socket for gripping a lug nut or lug head, turning means held to said socket holding means for turning said means, said turning means having two parts, first and second parts, extending at least partially opposite to the direction of the lug when the lug wrench is in operative position and offset with respect to it, the first part extending parallel with and opposed to the direction of the lug, and lever means connectable to the first part of the turning means in pivotal relationship, rotatable with respect to said first part of the turning means and bearable against the second part thereof, against which it applies a force so as to make a lever with a fulcrum where it is pivotally connected with the first part of the turning means and a point of application of force where it bears against the second part thereof, so that on applying a turning force to an end of such lever away from the fulcrum, the socket, when gripping a lug nut or lug head, applies a balanced turning force to said lug nut or lug head, thus facilitating ready release of a lug nut or a lug without the socket slipping off and said lug nut or lug because of application of unbalanced forces thereto.

7. A lug wrench according to claim 6 wherein the first and second parts of the turning means are so located that the distance from the fulcrum to the axis of the socket is about the same as the distance from such axis to the point at which the connectable lever means bears against the second part of the turning means, so that balanced rotational forces are applied to the socket when the turning force is applied to the connectable lever means.

8. A lug wrench according to claim 7 wherein the lever means pivotally connectable with the first part of the turning means includes a collar at an end thereof away from the end at which a force is applied to the lever, which collar and the lever are rotatable about said first part of the turning means, includes a handle or foot contact part away from the collar and extending substantially parallel to the lug direction and away from it and includes a portion extending substantially transversely to the lug direction when said lever means is positioned for use, which portion connects the collar and handle or foot contact part.

9. A lug wrench according to claim 8 wherein the first part of the turning means is of cylindrical shape and the collar part of the connectable lever fits about it closely and rotatably.

10. A lug wrench according to claim 9 wherein the second part of the turning means terminates in a pointed portion for assisting in removing an automobile wheel disc or cover from its position on said wheel.

* * * * *